United States Patent [19]

Janssens

[11] Patent Number: 5,056,666

[45] Date of Patent: Oct. 15, 1991

[54] PALLETS

[75] Inventor: Werner J. Janssens, Auckland, New Zealand

[73] Assignee: Janssens Industries Limited, New Zealand

[21] Appl. No.: 510,298

[22] Filed: Apr. 16, 1990

[30] Foreign Application Priority Data

Apr. 7, 1989 [NZ] New Zealand ..... 228669

[51] Int. Cl.[5] ..... B65D 19/12

[52] U.S. Cl. ..... 206/600; 108/56.3

[58] Field of Search ..... 108/56.3, 56.1; 206/600

[56] References Cited

U.S. PATENT DOCUMENTS 4,809,851 3/1989 Oestreich, Jr. et al. ..... 206/600

FOREIGN PATENT DOCUMENTS 067323 12/1982 European Pat. Off. ..... 206/600

211116 2/1987 European Pat. Off. ..... 206/600

*Primary Examiner*—William I. Price

*Attorney, Agent, or Firm*—Eckert Seamans Cherin & Mellott

[57] ABSTRACT

A pallet, especially for transporting or storing goods or materials which are somewhat fluid, preferably comprises a square or other rectangular base (10) and opposing pairs of walls (11, 12). An object is to provide a pallet which can be assembled, when required, and which can then be dismantled only by initial movement of one pair of the walls (12) towards the center of the pallet, i.e. against any outwards components of forces imposed on the walls by the contents of the pallet.

8 Claims, 1 Drawing Sheet

PALLETS

BACKGROUND OF THE INVENTION

This invention relates to pallets and particularly, but not exclusively, to pallets adapted to contain closed plastic bags in which fluid material may be transported or stored. Such pallets comprise a base and flat panels which can be assembled to form a rectangular or cubic box in which material can be transported or stored and which when empty after use, can be dismantled and the panels stored flat on the base for return as a compact unit.

It is an object of the present invention to provide a pallet, in which outward forces from the contents thereof tend to inhibit disconnection of the assembled pallet components.

BRIEF SUMMARY OF THE INVENTION

According to one aspect of the present invention, there is provided a pallet including a rectangular base and a plurality of wall panels to be erected on the base and in which, when they are erected, two adjacent panels are connected together by fastening means which are urged into engagement by outward components of forces applied to said two panels by any contents of the pallet.

Preferably, the fastening means are adapted to inhibit relative movement between said two panels in a direction parallel to the line formed by the junction of the adjacent edges of said panels.

Advantageously every corner of the pallet formed by the edges of adjacent panels includes said fastening means.

Where the pallet is rectangular (which expression includes square) a first opposing pair of the wall panels may include bottom fastening means at the bottom thereof to cooperate with first fastening means on the base, said bottom fastening means being adapted to fasten each of said first panels to the base by movement of the bottom of the first panel in an outward direction from the interior of the pallet and to inhibit movement of the bottom of the first panel in any direction other than an inward direction, a second opposing pair of the wall panels may include bottom fastening means at the bottom thereof to cooperate with second fastening means on the pallet base or on the first pair of wall panels near the bottom thereof, the bottom fastening means of the second pair of panels being adapted to fasten the second panels to the base or to the bottom of the first pair of panels by movement of the bottom of the second panels in a downward direction towards the base and to inhibit movement of the bottom of the second panels in any direction other than an upward direction, and in which the upper parts of adjacent panels of said first and second pairs of panels are connected together by said fastening means which are urged into engagement by the outward components of forces applied to the panels by the contents of the pallet, when assembled and at least partly filled.

BRIEF DESCRIPTION OF THE DRAWINGS

One embodiment of the invention is described, by way of example only, with reference to the accompanying drawings, in which.

DETAILED DESCRIPTION

Figure 2:
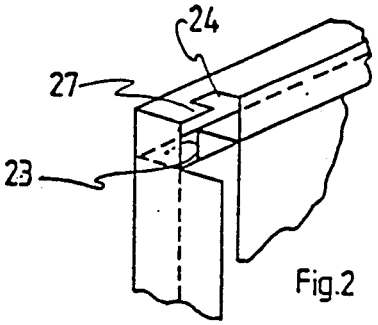
FIG. 2 is a view at enlarged scale of part of FIG. 1.

In the drawings, a pallet comprises a base 10, a pair of substantially identical side walls 11 opposite each other, and a pair of substantially identical front and rear walls 12, also opposite each other. The pallet is of rectangular plan, which is often square. In known manner, the walls 11, 12 may be disconnected from the base 10 and laid flat thereon to form a compact unit for transport or storage. Therefore, the walls 11, 12 are preferably square and of the same size as the base 10. The base 10 typically comprises longitudinal, parallel wooden members 13 fastened underneath by transverse boards 14 and on top by a sheet of plywood 15 or the like. The edge of the plywood 15 has affixed to the top surface thereof an angle metal frame 16 having an upstanding flange and having the centres of the sides thereof tied by metal straps 17. Two opposite sides of the frame 16 have a pair of short, inwardly pointing pegs 18.

The side panels 11, 12 are each bounded by a welded square-section, tubular frame 19, infilled with sheet material 20, preferably of corrugated or otherwise stiffened steel.

The outer faces of the bottom tubes of the frame 19 of the side panels 11 have a pair of spaced holes (unseen in the drawings) into which the pegs 18 are engaged, when the side panel 11 is first stood upright on the base 10 within the frame 16 and the panel 11 is then moved in an outward direction until the bottom tube of the panel 11 abuts the flange of the frame 16. Thus, the bottom of the panel 11 can only be disengaged from the base 10 by inward movement thereof.

Figure 3:
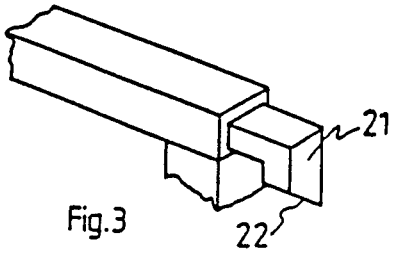
FIG. 3 is a view at enlarged scale of another part of FIG. 1.
Figure 1:
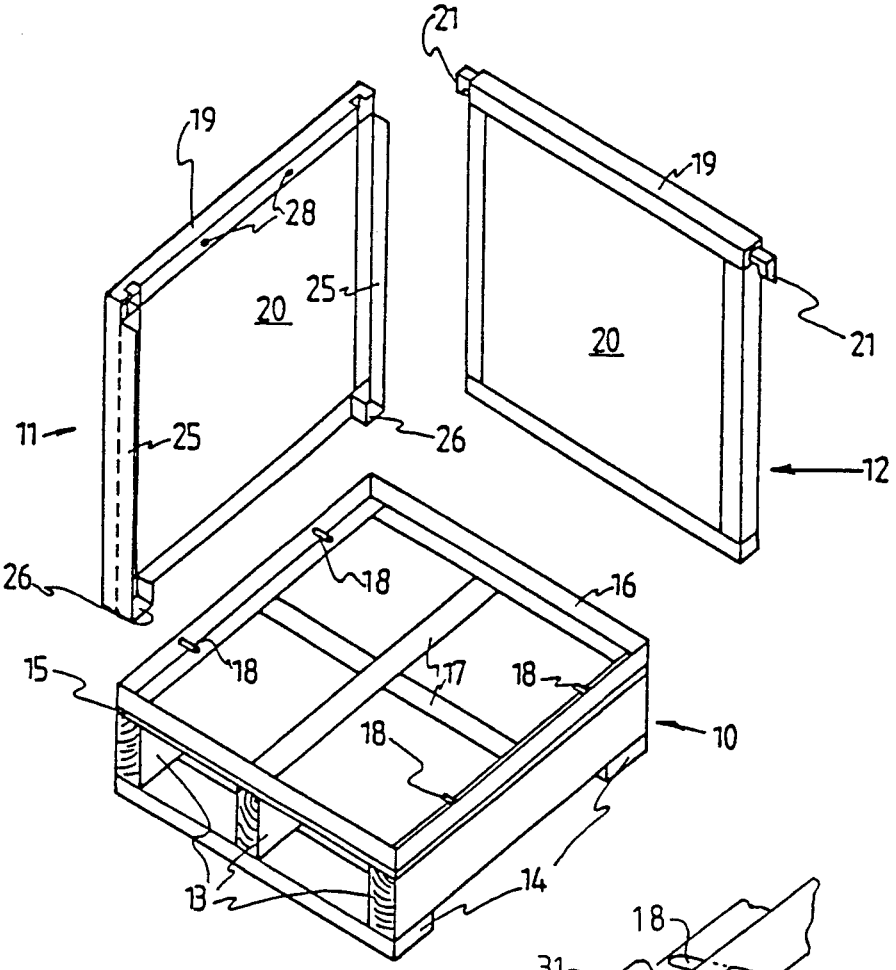
FIG. 1 is an exploded perspective view of part of a pallet, according to the invention.

Each top tube of the frame 19 of the front and rear panels 12 have fixed therein square-section hooks 21, of which the free ends are downwardly pointing and have sloping faces 22, as seen in FIG. 3.

At each top corner of the frame 19 of the side panels 11, a portion of the inner face of the tube is removed to form a square aperture 23, (as seen in FIG. 2), a notch 24 is formed in each end of the upper face of the frame 19 of each side panel 11, the notch 24 having a width and depth approximately equal to half the width of the tubes of the frame 19. The notch 24 opens into the aperture 23. Each upright edge of each side panel 11 is formed with an inwardly-directed flange 25, which extends from near the top of the panel 11 down to the base thereof, and then along the base for a short distance towards the centre thereof and then extends upwardly for a short distance. Thus, the lower portion of the flange 25 forms a U-shaped open topped socket, channel or hook 26.

Once the side panels 11 are engaged onto the pegs 18, the front and rear panels 12 can be lowered in turn inside the flanges 25 until the bottom corners of the panels 12 are engaged in the U-shaped sockets 26. At the same time, the hooks 21 enter through the notches 24 and protrude into the inside of the upright tubes of the frame 19 of the side panels 11. Due to an adequately loose fit of the bottom of the panels 12 in the sockets 26, the panels 12 can rock outwardly slightly until the upright tubes of the frame 19 of each panel 12 abut the flange 25 of the panels 11. At that position, the hooks 21 are positioned beneath a tongue 27 formed by the portion of the tube between the notch 24 and the top corner of the frame 19 of panel 11.

Once the panels 11, 12 have all been erected on the base 10, as described above, goods or materials can be put inside the pallet and provided those goods have a somewhat fluid property i.e. they will tend to move outwards within the pallet, and exert an outward force on the panels 11, 12, such outward forces will inhibit the panels 11, 12 from being disengaged from each other or from the base 10.

The pallet described so far is particularly appropriate for the conveyance of liquids by the insertion of a strong plastic bag within the pallet and then the bag being filled with the liquid to be transported or stored. If required, a lid can be put on the pallet and bolts on the lid can engage in holes 28 in the top tube of two or more of the frames 19. It will be seen that the pallet can be assembled or dismantled in a very short time without the use of bolts, clips or tools.

Figure 4:
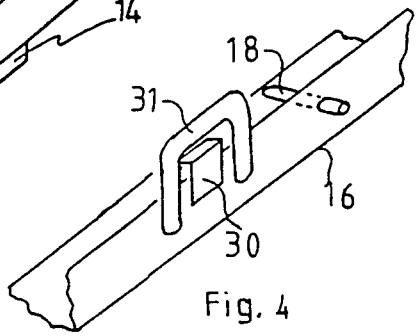
FIG. 4 is a view at enlarged scale of a further part of FIG. 1.

FIG. 4 shows, adjacent each peg 18, a short length of angle 30, welded to the frame 16, with the horizontal flange of the angle 30 protruding inwardly above the frame 16, so as to overly the bottom tube of the frame 19 of the panel 11, when the latter is engaged correctly on the pegs 18. If, during assembly of the pallet, an attempt is made to rest the bottom of the tube 19 on the upper surfaces of the pegs 18, the angle 30 will abut the tube 19, so that the incorrect assembly will thereby become obvious. Each angle 30 is conveniently protected by a loop 31 of inverted U-shaped bar, which can also serve as an anchorage for strapping or covers.

Instead of the channels 26 being formed on the side panels 11, they could be formed, for example, as part of the frame 16 of the base 10, on those sides of the frame 16 which do not carry the pegs 18.

I claim:

1. A pallet including a rectangular base and a plurality of wall panels to be erected on the base and in which, when they are erected, two adjacent panels are connected together by fastening means which are urged into engagement by outward components of forces applied to said two panels by contents of the pallet, and in which the pallet is rectangular and in which a first opposing pair of the wall panels includes first bottom fastening means at the bottom thereof to cooperate with first fastening means on the base, said bottom fastening means being adapted to fasten each of said first panels to the base by movement of the bottom of the first panel in an outward direction from an interior of the pallet and to inhibit movement of the bottom of the first panel in any direction other than an inward direction, a second opposing pair of the wall panels includes second bottom fastening means at the bottom thereof to cooperate with second fastening means on one of a pair of pallet components comprising the pallet base and on the first pair of wall panels near the bottom thereof, the second bottom fastening means of the second pair of panels being adapted to fasten the second panels to one of said pair of pallet components by movement of the bottom of the second panels in a downward direction towards the base and to inhibit movement of the bottom of the second panels in any direction other than an upward direction, and in which the upper parts of adjacent panels of said first and second pairs of panels are connected together by said fastening means which are urged into engagement by the outward components of forces applied to the panels by the contents of the pallet, when assembled and at least partly filled.

2. A pallet, as claimed in claim 1, in which the bottom fastening means of said second panels and said second fastening means are adapted to permit limited angular movement of the second panel about an axis parallel to the planes of the second panel and of the base.

3. A pallet, as claimed in claim 2, in which said second fastening means comprises at least one open-topped channel member.

4. A pallet, as claimed in claim 3, in which the bottom fastening means of the second panels comprise the bottom edges thereof.

5. A pallet, as claimed in claim 1 in which the first panel includes first abutment means to be contacted by part of said second panel to inhibit movement of said first panel in an outward direction from said second panel, and the second panel includes second and third abutment means to be contacted by parts of said first panel to inhibit movements of the second panel respectively in an outward direction from said second panel and from movement away from the base in a direction parallel to the line formed by the junction of the adjacent edges of said panels, when the pallet is in the assembled condition.

6. A pallet, as claimed in claim 1, in which said first fastening means on the base and the bottom fastening means of the first panel include a pair of fastening means of which one is a horizontally directed peg and the other is a hole to receive the peg.

7. A pallet, as claimed in claim 6, in which that member of the pallet which includes said peg also includes a protrusion substantially parallel to said peg and positioned at a higher level from the base than the peg, the protrusion being located so as to abut that member of the pallet which includes said hole, when an attempt is made to rest the bottom of the latter member on the upper surface of the peg.

8. A pallet, as claimed in claim 1, in which the pallet is square.

* * * * *